US006019367A

United States Patent [19]

Mandel et al.

[11] Patent Number: 6,019,367

[45] Date of Patent: Feb. 1, 2000

[54] PRINTER MAILBOX COMPILER-FINISHER CARRIAGE SAFETY STOP SYSTEM

[75] Inventors: Barry P. Mandel; Frederick A. Green, both of Fairport, N.Y.

[73] Assignee: Xerox Corporation, Stamford, Conn.

[21] Appl. No.: 09/144,139

[22] Filed: Aug. 31, 1998

[51] Int. Cl.[7] ..... B65H 39/10

[52] U.S. Cl. ..... 271/296; 271/300; 271/302; 188/67

[58] Field of Search ..... 271/296, 300, 271/302, 306, 200; 270/58.01; 188/67; 187/367, 361, 359, 350

[56] References Cited

U.S. PATENT DOCUMENTS

| | | | |
|---|---|---|---|
| 2,804,175 | 8/1957 | Phillips | 187/367 X |
| 5,342,034 | 8/1994 | Mandel et al. | 270/53 |
| 5,382,012 | 1/1995 | Mandel et al. | 270/53 |
| 5,449,158 | 9/1995 | Hirota et al. | 271/296 X |
| 5,513,839 | 5/1996 | Green | 270/53 |
| 5,603,492 | 2/1997 | Mandel et al. | 270/58.09 |
| 5,639,078 | 6/1997 | Mandel et al. | 270/58.12 |
| 5,823,300 | 10/1998 | Higuchi | 188/67 |

FOREIGN PATENT DOCUMENTS

| | | | |
|---|---|---|---|
| 2195320 | 4/1988 | United Kingdom | 271/296 |

*Primary Examiner*—David H. Bollinger

[57] ABSTRACT

In a multi-bin printed sheets distribution system, a simple safety system solution is provided for protection from accidental dropping of the vertically moving sheet distribution carriage by failure of its movement system. A safety stop member connects with both the tension member providing the carriage movement and the carriage. The safety stop member automatically repositions into stopping engagement with an adjacent vertical guide member in response to breakage or other release of tension in the tension member, to prevent the sheet distribution carriage from accidentally dropping. Preferably the repositioning is by a spring normally overcome by the tension in the tension member. The safety stop member may be a pivotally mounted plate with an aperture though which the guide member normally passes unobstructedly, which plate is both pivoted and laterally moved by the spring to lock to the guide member.

8 Claims, 5 Drawing Sheets

PRINTER MAILBOX COMPILER-FINISHER CARRIAGE SAFETY STOP SYSTEM

A safety system solution for a sheet output handling system such as a print job mailboxing, sorting or collating unit into which printed sheets from a printer or other reproduction apparatus are fed into selected ones of multiple sheet stacking bins or mailboxes, wherein a vertically movable sheet output diverter, compiler and/or finisher carriage is moved vertically relative to the selected output bin locations.

In particular, there is disclosed herein a low cost, simple yet effective safety stop system for preventing injury to equipment or personnel in the event of breakage or other failure in the vertical movement system of the sheet output carriage by automatically preventing accidental dropping thereof. The disclosed system can effectively prevent accidental dropping of even relatively heavy finishing carriages for printer output mailboxing systems such as those discussed below.

Although the present system can also be applicable to various other collators, finishers and the like, the specific example shown herein is in a printer "mailbox" system. By way of further background and further details of exemplary mailbox systems and their particular features and difficulties, there is noted the extensive discussion thereof, and the citation of other references in Xerox Corporation U.S. Pat. No. 5,342,034 issued Aug. 30, 1994 to the same Barry P. Mandel and Richard A. VanDongen; U.S. Pat. No. 5,603,492 issued Feb. 18, 1997; and U.S. Pat. No. 5,382,012 issued Jan. 17, 1995; to the same Barry P. Mandel and others. Note, e.g., that FIG. 1 of said U.S. Pat. No. 5,382,012 is essentially the same as FIG. 1 herein. Similar disclosures are also in other Xerox Corporation mailbox systems patents, such as Xerox Corporation U.S. Pat. No. 5,639,078 issued Jun. 17, 1997, and U.S. Pat. No. 5,513,839 issued May 7, 1996 to the same Frederick A. Green entitled "Dual Mode Sheet Stacking Tamper and Sheet Feeder Offset System". They include examples of printer mailboxing units with moving compiling and finishing carriages and their sheet feeding ejection systems for loading selected mailbox bins. Thus, such details need not be re-described herein.

As explained in these mailboxing systems patents by way of background, a mailboxing system is normally intended for separating plural page collated print jobs by users or clients into respective bins for the respective users, not for the collation of a print job by separating identical individual pages into different bins. Thus, in a mailboxing system, unlike a sorter or collator, the number of sheets to be compiled and placed in any one mailbox bin of the array of bins or mailboxes at any one time may vary greatly. Plural sheet plural precollated sets of stapled or unstapled sheets may be placed in individual bins. Also, the mailbox bins may not be filled sequentially.

This is in contrast to the operation of a sorter or collator system for post-collation of the plural copy sets of a plural page print job. A sorter or collator is normally placing identical copy sheets of the same page of the print job set (or document) sequentially in each bin, one sheet per bin at a time, then repeating that operation for the next page of the print job, until an identical job set of all the pages is fully collated in each bin (assuming the number of available sorter bins is equal to or greater than the number of desired sets of copies of the print job).

In the description herein, the term "sheet" or "copy sheet" refers to a usually flimsy physical sheet of paper, plastic, or other suitable physical substrate for images, whether precut or initially web fed. A finisher or finishing system can be a stapler, glue or tape binder, or other sheet set fastener.

A specific feature of the specific embodiment disclosed herein is to provide in a sheet handling system for the distribution of printed sheets to selected bins of a vertical array of multiple bins, in which a sheet distribution carriage is vertically movable relative to said vertical array of multiple bins for said distribution of printed sheets to said selected bins, wherein said sheet distribution carriage is normally vertically moved by and supported by a tension member under tension, and wherein said sheet distribution carriage is guided in said vertical movement by at least one adjacent guide member; the improvement comprising a repositionable safety stop member operatively connecting with both said tension member and said sheet distribution carriage and normally disengaged from said guide member, said repositionable safety stop member being automatically repositioned into engagement with said guide member to restrain vertical movement of said sheet distribution carriage upon a release of said tension in said tension member, to provide an automatic safety stop preclude dropping of said sheet distribution carriage by failure of said tension member.

Further specific features disclosed herein, individually or in combination, include those wherein said repositionable safety stop member both pivots and moves laterally on said sheet distribution carriage automatically upon said release of said tension in said tension member; and/or wherein there is a tension spring engaging said repositionable safety stop member in opposition to said normal tension in said tension member, and said safety stop member is automatically repositioned into engagement with said guide member by said tension spring in response to said release of said tension in said tension member; and/or wherein said sheet distribution carriage is a sheet compiler and finisher unit; and/or wherein said sheet distribution carriage is a sheet compiler-stapler unit of a printer output mailbox system; and/or wherein said safety stop member comprises an apertured plate, and said guide member extends through said aperture; and/or wherein said safety stop member comprises a pivotable apertured plate, and said guide member comprises a vertical channel member extending through said aperture, wherein said aperture is larger than said guide member and wherein said safety stop member does not engage said guide member unless said safety stop member is pivoted relative to said plate; and/or wherein there is a tension spring engaging said repositionable safety stop member at a position spaced from said aperture and in opposition to said normal tension in said tension member, and wherein said safety stop member is automatically pivoted into engagement with said guide member by said tension spring upon said release of said tension in said tension member.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned, and further features and advantages will be apparent from the specific apparatus and its operation shown and described in the example below, and from the abstract and claims. Thus, the present invention will be better understood from this description of one specific embodiment, including the drawing figures (approximately to scale) wherein:

As noted above, while the embodiment of the Figures is for a mailboxing system with a moving compiler/finishing system moving between selected fixed mailbox bins into which sheets or compiled sets of sheets are selectively placed, this is merely exemplary of the various versions, alternatives and applications of the present invention, which will vary depending upon the particular application and its sheet output system.

Figure 1:
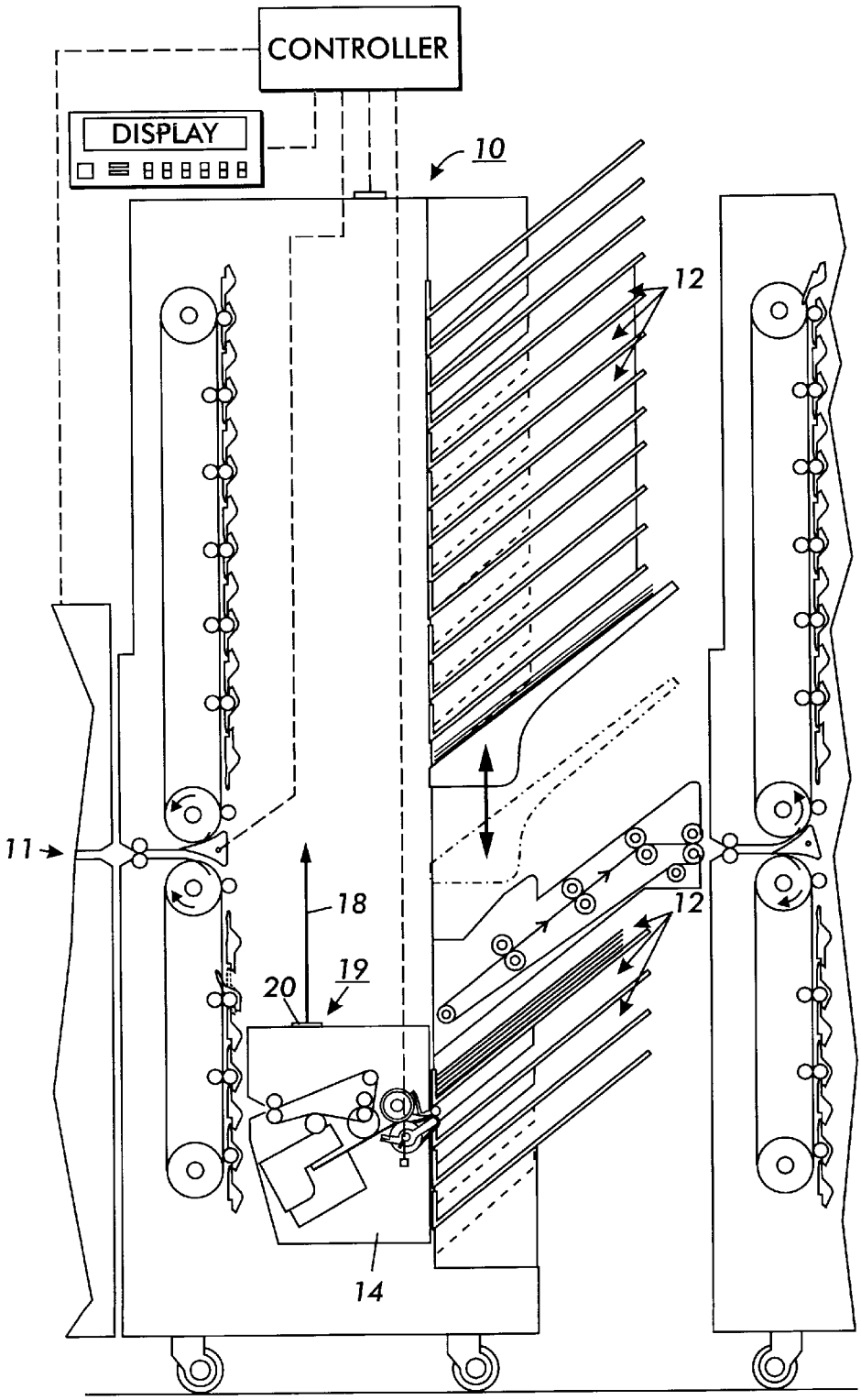
FIG. 1 is a plan schematic view of an example from an above indicated prior patent of a printer mailboxing system into which the present safety system may be incorporated.

Referring first to FIG. 1, there is shown one example of a mailboxing system further described in the above-cited patents. Here, a mailbox unit 10 has sheets sequentially entering its sheet entrance 11 from a printer, which sheets are fed to a vertically repositionable sheet compiling and finishing unit or carriage 14. The carriage 14 is vertically movable relative to, and adjacent to, a vertical array of such bins 12, intermittently stopping at a selected bin 12. The carriage 14 is guided in its movement along by a (at least one) vertical guide rail 16 (not shown in FIG. 1). The compiler/finisher carriage 14 here is relatively heavy and is vertically moved and positionally controlled via a connecting lift cable 18 driven by a conventional carriage lifting motor/pulley system. The mailbox unit 10 operation may all be under the control of a programmable controller with an associated keypad entry system and display as shown in FIG. 1. As described in detail in the above-cited patents, this mailbox unit 10 feeds sheets on from its input 11 with a sheet transport and gating system similar to that in use in many sorters or collators, with a variable position gating system for selectably gating and deflecting sheets at different selected vertical levels. In the mailbox unit 10 the sheets may be deflected into the intermediate compiling and finishing unit 14 at different vertical positions thereof, rather than directly in a bin 12 or other output tray. It will be appreciated, however, that the unit 10 or alternative systems could alternatively be utilized for or operated as a sorter or collator, by feeding individual sheets directly out into a selected bin 12, and moving the carriage 14, or another type of sheet deflector unit, after each sheet has been fed into a bin. However, as described in the above-cited patents, that is not the desired function of this particular mailbox unit 10, which is to normally sequentially feed pre-collated sheets into the stacking tray in the carriage unit 14 until one collated document set or print job set is compiled therein, then to staple or otherwise fasten that document set together in the unit 14, and then to feed that stapled document set into a selected one of the bins 12 designated or assigned to a particular user, or a particular group of users. If the sheets are not to be stapled or otherwise bound in the compiler/finisher unit 14, they may be directly sequentially fed through unit 14 into a bin 12 to be compiled and stacked therein. This is all fully described in the abovecited references.

Figure 2:
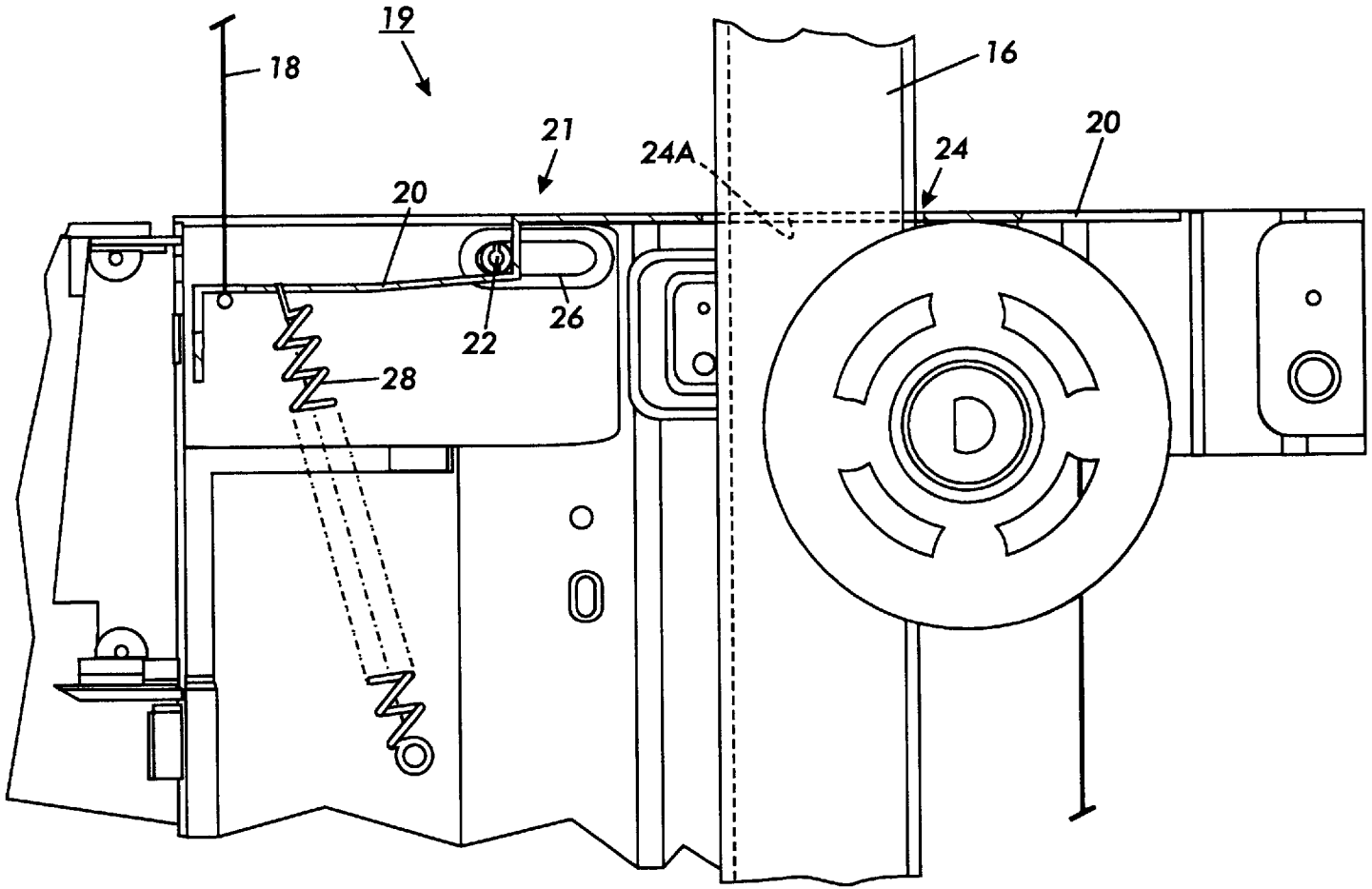
FIG. 2 is an enlarged plan view, partially in cross-section, of a portion of such a mailboxing system, illustrating one example of the subject safety system inoperative in normal operation of the mailboxing system.
Figure 3:
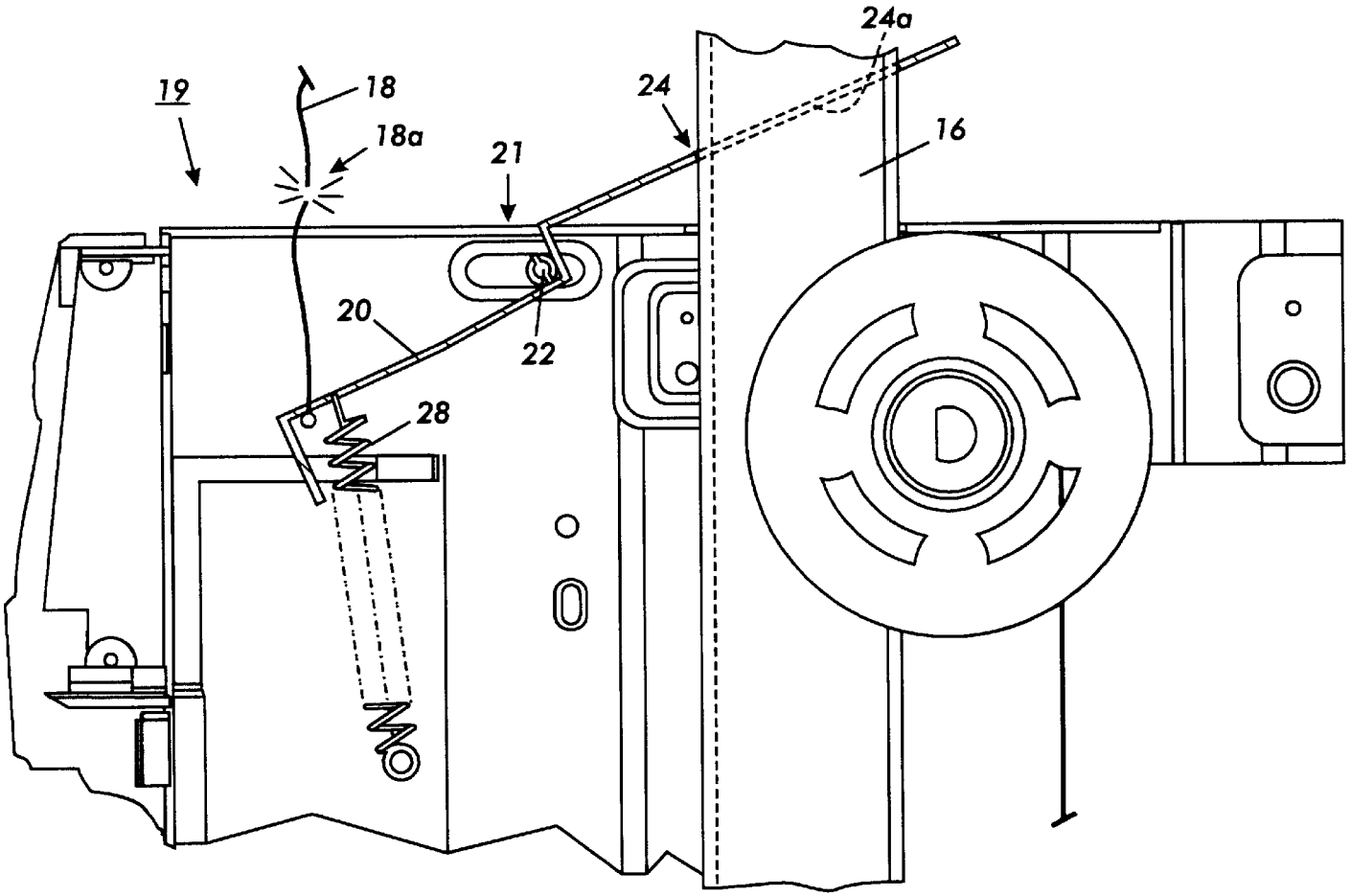
FIG. 3 shows the automatic operation of the exemplary safety system of FIG. 2 upon the accidental breakage of the lift cable of the compiler/finisher carriage.
Figure 4:
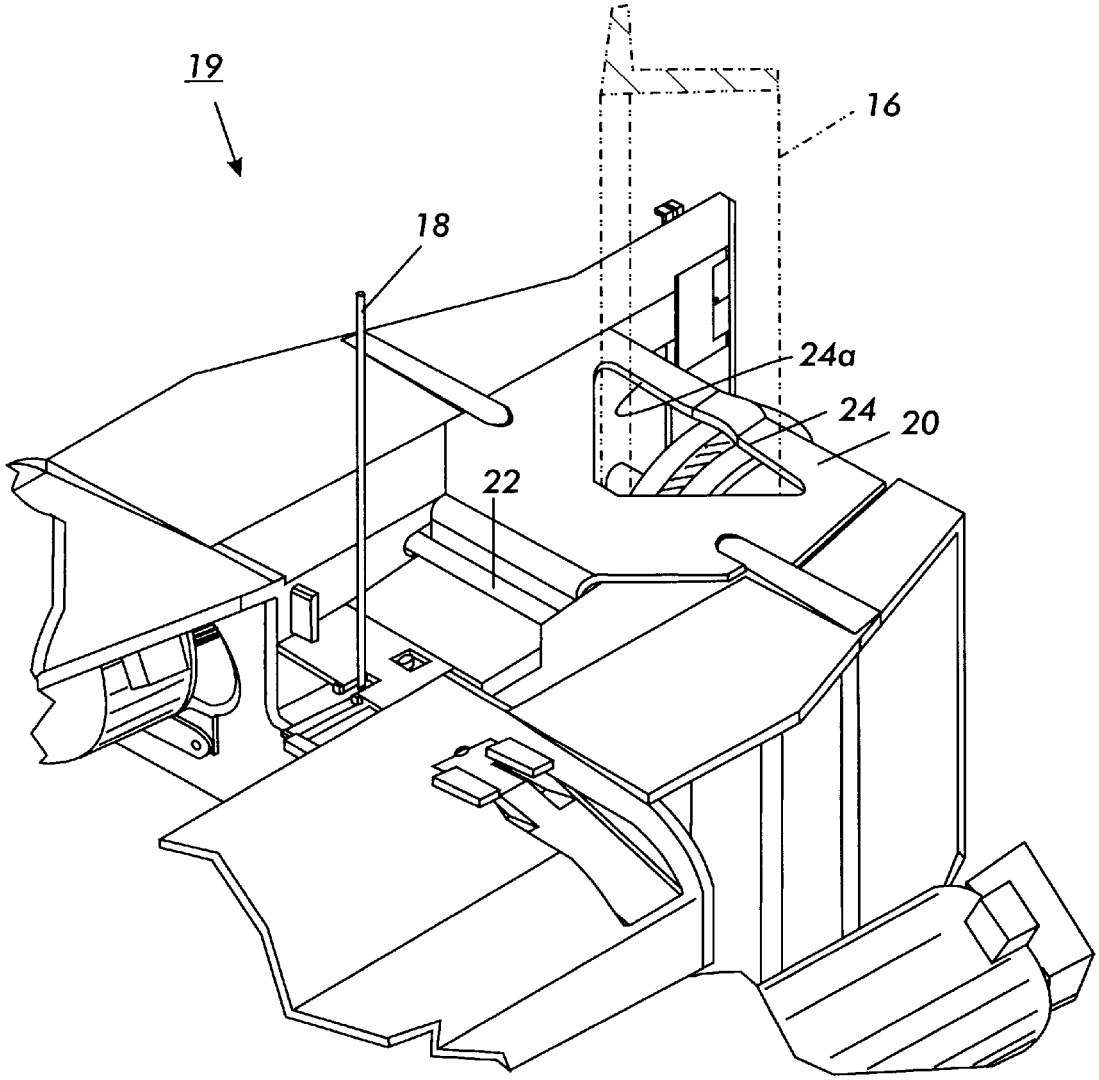
FIG. 4 is a perspective view of the exemplary safety system of FIG. 2 in normal operation of the mailboxing system.
Figure 5:
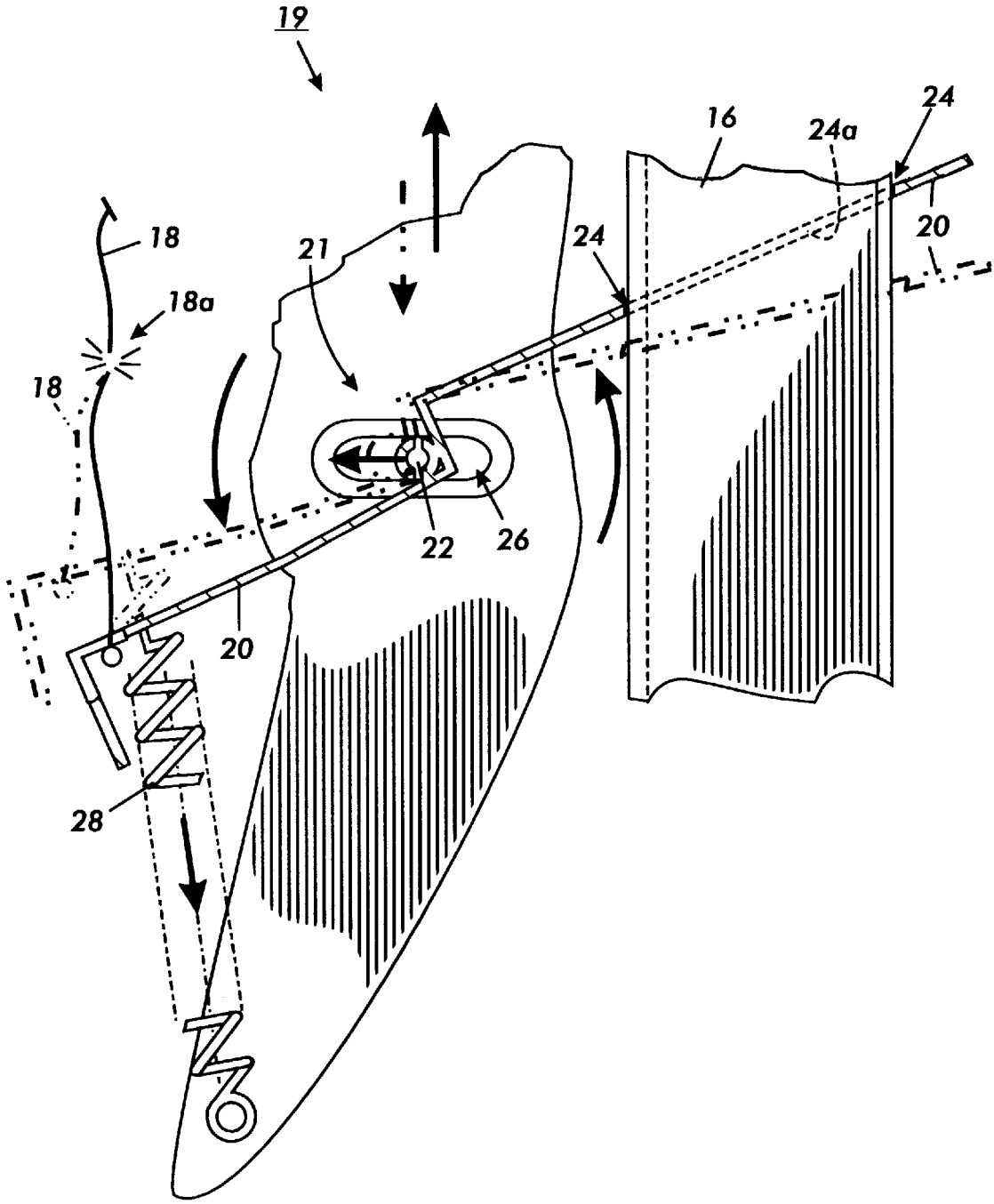
FIG. 5 is a further enlarged partial view of the FIG. 3 automatic operation of the exemplary safety system of FIG. 2 upon the accidental breakage of the lift cable of the compiler/finisher carriage, with illustrative motion arrows.

Turning now to the enlarged views of FIGS. 2 and 4, there is illustrated one example of the subject simple, low cost, yet effective, safety system 19 in the normal operation of this mailboxing system, in which this safety system is inoperative, that is, does not affect the normal operation of the mailbox unit 10. As shown in FIGS. 3 and 5, in contrast, if there is a breakage or other failure of the lift cable 18 or its lifting system, illustrated here by an exemplary cable break point 18*a*, this safety system 19 is automatically actuated to prevent the accidental dropping of the carriage 14. The safety system 19 in this example comprises a simple stop bracket 20 mounted on and moving with the carriage 14 and connecting the end of the cable 18 to the carriage 14. Normally, the stop bracket 20 is stationary relative to the carriage 14, held by a stop in the generally horizontal position shown in FIGS. 2 and 4. Thus, normally, an aperture 24 in the bracket 20 surrounds but does not engage the guide rail 16, here an "L" channel.

However, when the lift cable 18 breaks, the stop bracket 20 pivots and moves as shown in FIGS. 3 and 5 to lock the stop bracket 20 to the guide rail 16 to prevent the carriage 14 from dropping, by the outer edge 24*a* of the aperture 24 of the bracket 20 engaging the outside edges of the guide rail 16. As shown, this is provided here by a central arcuate pivot area 21 of the bracket 20 about which the bracket 20 pivots around a pivot pin 22 which is held in a horizontal slot 26 in the carriage 14 frame. The slot 26 allows lateral movement of the pivot pin 22 (and thus the bracket 20) as well as pivotal rotation of the bracket 20. As particularly shown in FIG. 5, this allows the tension in a spring 28 (normally overcome by the lifting tension force of the unbroken lift cable 18) to so move bracket 20 into locking engagement with the guide rail 16 as soon as the lifting force of cable 18 is removed, as by the cable 18 breaking at 18*a*. To describe this in other words, if the cable 18 loses tension for any reason, so that the carriage 14 is no longer being held up by cable 18, spring 28 causes the stop plate 20 to pivot and slide in its support slots relative to carriage 14 to lock onto the support rail 16 to prevent the accidental dropping of carriage 14. The safety stop member here comprises a pivotable apertured (24) plate 20, and the guide rail or member 16 here comprises a vertical channel member extending through the aperture 24. The aperture 24 is larger than the guide member 16 so that the stop plate 20 does not engage the guide member 16 unless the stop plate is pivoted relative to the guide member 16.

It may be seen that this illustrated mechanism is very small, light and simple in comparison to safety stop mechanisms for human transporting elevators or lifts, and does not require any extra cables, racks, electromechanical controls, or the like.

It will be appreciated that other specific structures or mechanisms can be used to achieve the above-described movements and/or functions. Thus, while the embodiment disclosed herein is generally preferred, it will be appreciated from this teaching that various alternatives, modifications, variations or improvements therein may be made by those skilled in the art, which are intended to be encompassed by the following claims.

What is claimed is:

1. In a sheet handling system for the distribution of printed sheets to selected bins of a vertical array of multiple bins, in which a sheet distribution carriage is vertically movable relative to said vertical array of multiple bins for said distribution of printed sheets to said selected bins, wherein said sheet distribution carriage is normally vertically moved by and supported by a tension member under tension, and wherein said sheet distribution carriage is guided in said vertical movement by at least one adjacent guide member; the improvement comprising a repositionable safety stop member operatively connecting with both said tension member and said sheet distribution carriage and normally disengaged from said guide member, said repositionable safety stop member being automatically repositioned into engagement with said guide member to restrain vertical movement of said sheet distribution carriage upon a release of said tension in said tension member, to provide an automatic safety stop preclude dropping of said sheet distribution carriage by failure of said tension member.

2. The sheet handling system of claim 1, wherein said repositionable safety stop member both pivots and moves laterally on said sheet distribution carriage automatically upon said release of said tension in said tension member.

3. The sheet handling system of claim 1, wherein there is a tension spring engaging said repositionable safety stop member in opposition to said normal tension in said tension member, and said safety stop member is automatically repositioned into engagement with said guide member by said tension spring in response to said release of said tension in said tension member.

4. The sheet handling system of claim 1, wherein said sheet distribution carriage is a sheet compiler and finisher unit.

5. The sheet handling system of claim 1, wherein said sheet distribution carriage is a sheet compiler-stapler unit of a printer output mailbox system.

6. The sheet handling system of claim 1, wherein said safety stop member comprises an apertured plate, and said guide member extends through said aperture.

7. The sheet handling system of claim 1, wherein said safety stop member comprises a pivotable apertured plate, and said guide member comprises a vertical channel member extending through said aperture, wherein said aperture is larger than said guide member and wherein said safety stop member does not engage said guide member unless said safety stop member is pivoted relative to said plate.

8. The sheet handling system of claim 7, wherein there is a tension spring engaging said repositionable safety stop member at a position spaced from said aperture and in opposition to said normal tension in said tension member, and wherein said safety stop member is automatically pivoted into engagement with said guide member by said tension spring upon said release of said tension in said tension member.

* * * * *